United States Patent [19]

Santemma et al.

[11] 3,996,054

[45] * Dec. 7, 1976

[54] COLOR PHOTOGRAPHIC DEVELOPING SOLUTION

[75] Inventors: Hector J. Santemma; Richard S. Fisch, both of Montgomery, N.Y.

[73] Assignee: Minnesota Mining and Manufacturing Company, St. Paul, Minn.

[ * ] Notice: The portion of the term of this patent subsequent to Jan. 15, 1991, has been disclaimed.

[22] Filed: Dec. 26, 1973

[21] Appl. No.: 427,666

Related U.S. Application Data

[63] Continuation-in-part of Ser. No. 183,675, Sept. 24, 1971, abandoned.

[52] U.S. Cl. ..... 96/66 R; 96/66.1; 96/22

[51] Int. Cl.[2] ..... G03C 5/30; G03C 7/16

[58] Field of Search ..... 96/66, 66.1, 22, 55

[56] References Cited

UNITED STATES PATENTS

| | | | |
|---|---|---|---|
| 2,936,308 | 5/1960 | Hodge | 96/66 |
| 3,141,897 | 7/1964 | Crecelius et al. | 252/356 |
| 3,385,834 | 5/1968 | Merijan | 252/356 |
| 3,589,902 | 6/1971 | Himmelman | 96/66 |
| 3,723,127 | 3/1973 | Yano et al. | 96/96 |
| 3,746,544 | 7/1973 | Heilmann | 96/55 |

FOREIGN PATENTS OR APPLICATIONS

| | | | |
|---|---|---|---|
| 875,453 | 8/1961 | United Kingdom | 96/66 |

*Primary Examiner*—Mary F. Kelley
*Attorney, Agent, or Firm*—Alexander, Sell, Steldt & Delahunt

[57] ABSTRACT

Color development of a silver halide photographic element containing dispersed couplers is improved by developing the elements in the presence of an alkyl glycol ether or an aryl glycol ether.

6 Claims, No Drawings

COLOR PHOTOGRAPHIC DEVELOPING SOLUTION

This application is a continuation-in-part of Ser. No. 183,675, filed Sept. 24, 1971, now abandond.

The present invention relates to color development of silver halide photographic elements, and more particularly relates to developer solutions, solution concentrates, and methods for color development.

One system of silver halide color photography employs silver halide photographic elements which have a plurality of silver halide layers, each layer having a photographic color coupler dispersed therein by the solvent dispersion technique. This technique involves dispersing, in a silver halide emulsion, very fine droplets of a high boiling, water-immiscible solvent such as tricresyl phosphate in which is dissolved a color coupler. Reference is made to U.S. Pat. Nos. 2,332,027 and 2,801,170.

During color development of the so-described silver halide element, silver halide is reduced by the developing agent to silver, and the developing agent is oxidized. The oxidation product of the developing agent then "couples" with the color coupler which is included within the silver halide emulsion to form a dye, as is well known to the art. Color development of the so-described silver halide element, however, produces only a very weak colored image unless the developing solution additionally contains an aromatic alcohol, such as benzyl alcohol. Reference is made to British Pat. No. 546,347. It is believed that the aromatic alcohol serves as a solvent for the very fine droplets of water-immiscible, high boiling solvent which are dispersed in the silver halide emulsion, thus promoting access of the oxidized color developing agent to the color coupler contained within such droplets.

Of the aromatic alcohols referred to above, benzyl alcohol has thus far been greatly preferred by the art. Benzyl alcohol unfortunately has an odor which is disagreeable to photographic processing technicians. Moreover, benzyl alcohol is quite volatile, and the high processing temperature techniques currently employed accordingly tend to vaporize benzyl alcohol. Or perhaps greatest importance, however, benzyl alcohol is a solvent or partial solvent for certain plastic materials such as nylon and neoprene, which plastic materials are desired for use in automatic processing machines which currently are widely used for photographic processing. Swelling, by benzyl alcohol, of the plastic rollers used in such processing machines may cause the machines to jam or to otherwise malfunction. Further, the action of benzyl alcohol on such plastic rollers may cause the rollers to lose their "gripping" characteristics which are relied upon to transport photographic film through such machines. Elimination of benzyl alcohol or other aromatic alcohols from color photographic developing solutions is hence greatly to be desired.

It is an object of this invention to provide a color developing solution for developing silver halide photographic emulsions having couplers dispersed therein by the solvent dispersion technique, which solution is substantially free of aromatic alcohols.

It is another object of the invention to provide a color developing solution for developing silver halide photographic materials containing couplers dispersed therein by the solvent dispersion technique, which developing solutions are substantially odor-free and which do not corrode or swell plastic materials commonly employed in automatic photographic developing machines.

It is another object of the invention to provide an aqueous solution concentrate capable of use in a photographic color developer kit for preparing color developing solutions which are substantially odor-free and which are substantially non-corrosive or non-swelling of plastic materials commonly employed in photographic processing machines.

Briefly, it has now been found that certain alkyl- and aryl glycol ethers can be employed as a solvent in color photographic developer solutions in place of the previously preferred benzyl alcohol or other aromatic alcohols. Accordingly, the invention in one embodiment relates to a color developing solution for developing silver halide photographic elements. The developing solution comprises, in aqueous alkaline solution, a p-phenylenediamine color developing agent, and a glycol ether compound of the formula $$R-O-(\underset{R_1}{\underset{|}{CH}}-\underset{R_2}{\underset{|}{CH}}-O)_n-H$$

wherein R is a $C_1 - C_{10}$ alkyl group or an aryl group having no more than 10 carbon atoms, $R_1$ and $R_2$ each independently represent a hydrogen atom or a $C_1 - C_3$ alkyl group with the proviso that at least one of $R_1$ and $R_2$ is hydrogen, and $n$ is an integer of from 1 to 5. "Color developing solution," as used herein, includes developer replenisher solutions.

Color developing solutions are often prepared by the user from photographic developer "kits," the user merely combining and diluting the kit contents to form a working color developer solution. The kits may contain two or three or more separately packaged compositions, and ordinarily one of these compositions comprises an aqueous dispersion of benzyl alcohol in water. Accordingly, the present invention in another embodiment relates to an aqueous concentrate for use in a photographic color developer kit. The concentrate comprises a solution or a dispersion, in water, of a glycol ether compound of the formula set forth above wherein R, $R_1$, $R_2$ and $n$ are as set forth above, preferably in a concentration of at least 50 ml/l. The concentrate also comprises a photographically acceptable dispersing agent for dispersing the glycol ether in water in the event that the concentration of glycol ether exceeds the solubility thereof in water, as is preferred.

As noted above, the use of the so-defined glycol ethers as adjuvants in a photographic color processing solution permits highly acceptable color images to be produced and further avoids the odor, volatility, and processing machine problems associated with benzyl alcohol or other aromatic alcohols. Accordingly, in yet another embodiment, the invention relates to an improvement in the method for developing an exposed silver halide photographic element which includes at least one silver halide layer containing dispersed therein a color coupler dissolved in a high-boiling, water-immiscible solvent, which comprises treating the element with a p-phenylenediamine color developing agent in aqueous alkaline solution. The improvement comprises contacting the silver halide layer concurrently with development thereof with a glycol ether of the formula set forth above wherein R, $R_1$, $R_2$ and $n$ are as set forth above.

Examples of commercially available glycol ether solvents of the present invention (and solubilities of certain of these compounds in water at 60° C) include ethylene glycol monophenyl ether (27 ml/l.),
propylene glycol monophenyl ether (56 ml/l.),
ethylene glycol monohexyl ether (9.9 ml/l.),
diethylene glycol monohexyl ether (17 ml/l.),
diethylene glycol monophenyl ether
propylene glycol isobutyl isobutyl (29 ml/l.), and mixtures thereof. The glycol ether solvents of the invention must be sufficiently water soluble so as to be capable of dissolving in an aqueous photographic color developer solution, but must not be so soluble in water as not to be good solvents for the high-boiling, water-immiscible solvents utilized in the solvent dispersion technique as described above. The glycol ether solvents of the invention are characterized by exhibiting a solubility in water at 60° C of from about 10 g/l to about 100 g/l.

The color developing solution of the present invention is alkaline (e.g., of at least about pH 9.5 and preferably above about pH 9.9) so as to promote the color developing reaction, and will contain a p-phenylenediamine color photographic developing agent. As will be recognized by those skilled in the art, such developing agents are capable of reducing silver halide to silver. The developing agent concurrently is oxidized, and the oxidation product of the developer is capable of reacting (e.g., "coupling") with a color coupler compound to form a dye. Suitable developing agents for use in the present invention are described for example, in Mees & James, eds, *The Theory of the Photographic Process*, 3rd edition, MacMillan, New York, 1966, pp 293–298.

The amount of glycol ether solvent as described above which is included within the developer solutions of the invention may vary widely depending inter alia upon the characteristics of the color material to be processed, and this concentration can be easily determined by the skilled artisan. Concentrations of glycol ether solvents of from 2 to 20 g/l have yielded acceptable results. In addition, the developing solutions of the invention may include various other photographic adjuvants which are commonly utilized in color developing solutions, for example, development restrainers such as bromide ion, etc., bases such as alkali metal hydroxides, buffers such as citrates, borates, carbonates, etc., antifoggants such as benzotriazole, sequestering agents such as ethylenediamine tetraacetic acid, antioxidants such as sulfite, etc., oxidation inhibitors such as ascorbic acid, black and white developers such as hydroquinone, etc.

In concentrate form, a glycol ether solvent of the invention may be dispersed in water with the aid of a photographically acceptable dispersing agent. By "photographically acceptable" is meant that the dispersing agent does not significantly affect the photographic characteristics ability of the developing solution. The solvent concentrates of the invention are preferably provided as water dispersions to promote the dissolution of the solvents in the working developer upon preparation thereof. It has been found that a water dispersion of a solvent of the invention will dissolve in a working color developer solution much more rapidly than will the pure solvent itself. Suitable dispersing agents for the glycol ether solvents of the invention include water-soluble polymeric carbohydrates or polymeric amides such as those described in Belgian Pat. No. 731,368, and the stability of these dispersions is improved by incorporating therein such ionized materials as alkali metal sulfites, sulfates, phosphates, citrates, and the like. These dispersing agents and their derivatives include such materials as Guar gums and derivatives thereof, water-soluble cellulose emulsifying agents such as cellulose sulfate, cellulose acetate sulfate, cellulose acetate, sodium alginate, sodium hydroxy propyl alginate, methyl cellulose, ethyl cellulose phthalates, mixed ethers of cellulose such as isopropyl methyl ethers and the like, and hydroxyethyl cellulose materials. Such polymeric amides as soya protein, lecithin, and especially gelatin and water soluble derivatives of gelatin have given acceptable results. Particularly desirable as dispersing agents useful in the present invention are copolymers of maleic anhydride with ethylenically unsaturated monomers such as styrene, vinyl ethers, and ethylene, as are referred to in a copending application of R. S. Fisch and entitled "Photographic Aqueous Dispersion Concentrates" (attorney's file No. 27,094).

The amount of dispersing agent to be used in concentrates of the present invention may vary widely, and the optimum amount of dispersing agent may be easily determined experimentally. Normally, from about 0.5 to about 15, and preferably about 1.5 to about 6.0, grams of dispersing agent per liter of concentrate solution have given acceptable results. The concentrates of the present invention in the preferred form may be easily manufactured by vigorously agitating a mixture of a glycol ether solvent of the invention with water and a dispersing agent, agitation being continued until the glycol ether is dispersed as fine droplets throughout the continuous water phase.

The concentrates of the invention may include such photographic adjuvants as are common in the art, such as hydroxylamine salts, bromide ions, sulfite, and developing agents as described above, if desired.

The invention may be more easily understood by reference to the following illustrative, non-limiting examples wherein the photographic color developing agent in each example is 4-amino-N-ethyl-N-(β-methanesulfonamidoethyl)-m-toluidine sesquisulfate, and wherein the photosensitive silver halide materials in each example comprises support bearing a plurality of silver halide layers thereon, each layer containing a dispersion, in a high-boiling, water-immiscible liquid vehicle, of a photographic color coupler.

It is to be further noted that the preferred embodiments of the present invention are developing solutions which, in addition to the color developing agent and the glycol ether, includes at least 0.01 moles of hydroxylamine sulfate as a stabilizer. Sodium sulfite may also preferably be used in combination with the hydroxylamine sulfate. When hydroxylamine sulfate is used in the developer solutions or concentrates of this invention, it is essential that there be no ethylenediaminetetraacetic acid (EDTA) present, or at least only minor amounts thereof. EDTA causes the hydroxylamine sulfate to decompose, releasing ammonia. Although the absence of EDTA is preferred, solutions according to this invention having insufficient EDTA to cause more than 5 percent decomposition of hydroxylamine sulfate upon standing at ambient temperatures for 30 days is tolerable. This is a very small amount of EDTA which is tolerable and can be defined functionally as the substantial absence of EDTA.

EXAMPLE 1

A photographic color developer working solution was prepared as follows:

| | |
|---|---|
| Potassium bromide | 0.50 g/l |
| Hydroxylamine sulfate | 3.54 g. |
| Ethylene glycol monophenyl ether | 13.75 g. |
| Potassium hydroxide (45% aqueous solution) | 29.75 ml. |
| Boric acid | 20.08 g. |
| Sodium sulfite | 1.43 g. |
| Color developing agent | 3.80 g. |
| Sequestering agent (Antical-3, Eastman Kodak Co.) | 2.91 g. |
| Water to | 1000 ml. |

A silver halide color photographic element was exposed to a light image and processed in the above developer for 6 minutes. The element was subsequently processed through further photographic processing solutions, including a short stop solution, a silver bleach solution, a fixing solution and a stabilizing solution. The finished photographic reproduction exhibited a dense, highly satisfactory color image.

EXAMPLE 2

A developer replenisher for the above color developer working solution was prepared as follows:

| | |
|---|---|
| Potassium bromide | 0.25 g/l |
| Ethylene glycol monophenyl ether | 14.0 g. |
| Hydroxylamine sulfate | 3.36 g. |
| Potassium hydroxide (45% aqueous solution) | 33.07 ml. |
| Boric acid | 19.1 g. |
| Sodium sulfite | 1.77 g. |
| Color developing agent | 5.22 g. |
| Sequestering agent (Antical-3, a product of Eastman Kodak Co.) | 2.95 g. |
| Water to | 1000 ml. |

EXAMPLE 3

A 3-part kit for producing a photographic color developer replenisher solution was prepared as follows:

| | | |
|---|---|---|
| Part A | | |
| | Ethylene glycol monophenyl ether | 13.68 g. |
| | Hydroxy methyl cellulose (Natrosol 250 A, a product of Hercules Corp.) | 0.06 g. |
| | Hydroxyl amine sulfate | 3.36 g. |
| | Water to | 40 ml. |
| Part B | | |
| | Potassium bromide | 0.23 g. |
| | Potassium hydroxide (45% aqueous solution) | 33.1 ml. |
| | Boric acid | 19.1 g. |
| | Sequestering agent (Antical-3, a product of Eastman Kodak Co.) | 2.95 g. |
| | Sodium sulfite | 1.58 g. |
| | Water to | 50 ml. |
| Part C | | |
| | Color developer | 5.22 g. |
| | Sodium sulfite | 0.192 g. |
| | Water to | 10.0 ml. |

The contents of parts A, B and C are dissolved in order to 600 ml. of water, and the resulting solution is diluted to 1000 ml. with water to make a photographic color developer replenisher solution similar to that of Example 2.

EXAMPLES 4 – 8

The developer described in Example 1 was duplicated exactly except that the ethylene glycol monophenyl ether employed therein was replaced respectively with propylene glycol isobutyl ether, propylene glycol monophenylether, ethylene glycol monohexyl ether, diethylene glycol monohexyl ether and diethylene glycol monophenyl ether. Results similar to those reported in Example 1 were obtained.

What is claimed is:

1. A color developing solution for developing silver halide photographic elements comprising in aqueous alkaline solution a p-phenylenediamine color developing agent and a glycol ether compound having a solubility in water at 60° C. in the range of from 10 g/l to 100 g/l of the formula $$R-O-(\underset{R_1}{\underset{|}{CH}}-\underset{R_2}{\underset{|}{CH}}-O)_n H$$

wherein R is a $C_1 - C_{10}$ alkyl group or an aryl group having no more than 10 carbon atoms, $R_1$ and $R_2$ each independently represent a hydrogen atom or a $C_1 - C_3$ alkyl group with the proviso that at least one of $R_1$ and $R_2$ is hydrogen, and $n$ is an integer of from 1 to 5, in the substantial absence of ethylenediaminetetraacetic acid.

2. The color developing solution of claim 1 additionally comprising ascorbic acid as an oxidation inhibitor.

3. The color developing agent of claim 1 additionally comprising a carbonate alkaline buffer.

4. In the method for developing an exposed silver halide photographic element which includes at least one silver halide layer containing dispersed therein a color coupler dissolved in a high-boiling, water-immiscible solvent, which method comprises treating said element with a p-phenylenediamine color developing agent in aqueous alkaline solution, the improvement which comprises contacting said silver halide layer concurrently with development thereof with a glycol ether having a solubility in water at 60° C. in the range of from 10 g/l to 100 g/l of the formula $$R-O-(\underset{R_1}{\underset{|}{CH}}-\underset{R_2}{\underset{|}{CH}}-O)_n H$$

wherein R is a $C_1 - C_{10}$ alkyl group or an aryl group having no more than 10 carbon atoms, $R_1$ and $R_2$ each independently represent a hydrogen atom of a $C_1 - C_3$ alkyl group with the proviso that at least one of $R_1$ and $R_2$ is hydrogen, and $n$ is an integer of from 1 to 5.

5. The method of claim 4 wherein said glycol ether is included in said aqueous, alkaline solution.

6. The solution of claim 1 wherein there is no ethylenediaminetetraacetic acid present.

* * * * *

UNITED STATES PATENT AND TRADEMARK OFFICE

CERTIFICATE OF CORRECTION

PATENT NO. : 3,996,054

DATED : December 7, 1976

INVENTOR(S) : Hector J. Santemma and Richard S. Fisch

It is certified that error appears in the above-identified patent and that said Letters Patent are hereby corrected as shown below:

Column 3, line 9 "glycol isobutyl isobutyl" should be --glycol isobutyl ether--.

Signed and Sealed this

Twelfth Day of April 1977

[SEAL]

*Attest:*

RUTH C. MASON
*Attesting Officer*

C. MARSHALL DANN
*Commissioner of Patents and Trademarks*